US010328460B2

(12) United States Patent
Hellwig et al.

(10) Patent No.: US 10,328,460 B2
(45) Date of Patent: Jun. 25, 2019

(54) COATING

(71) Applicant: P2i Ltd, Abingdon (GB)

(72) Inventors: Thomas Hellwig, Abingdon (GB); Victoria Sullivan, Abingdon (GB)

(73) Assignee: P2i Ltd, Abingdon (GB)

( * ) Notice: Subject to any disclaimer, the term of this patent is extended or adjusted under 35 U.S.C. 154(b) by 0 days.

(21) Appl. No.: 15/121,321

(22) PCT Filed: Feb. 24, 2015

(86) PCT No.: PCT/GB2015/050521
§ 371 (c)(1),
(2) Date: Aug. 24, 2016

(87) PCT Pub. No.: WO2015/128627
PCT Pub. Date: Sep. 3, 2015

(65) Prior Publication Data

US 2017/0066013 A1 Mar. 9, 2017

(30) Foreign Application Priority Data

Feb. 28, 2014 (GB) ..... 1403558.8

(51) Int. Cl.
*B05D 7/22* (2006.01)
*B05D 1/00* (2006.01)
(Continued)

(52) U.S. Cl.
CPC ..... *B05D 7/22* (2013.01); *B05D 1/62* (2013.01); *B05D 3/0493* (2013.01); *B05D 3/145* (2013.01)

(58) Field of Classification Search
CPC ..... B05D 7/22; B05D 1/62; B05D 3/0493; B05D 3/145
See application file for complete search history.

(56) References Cited

U.S. PATENT DOCUMENTS 4,822,632 A 4/1989 Williams et al.
6,613,393 B1 9/2003 Rauschnabel et al.
(Continued)

FOREIGN PATENT DOCUMENTS

EP 0834352 A1 4/1998
EP 1557489 A1 7/2005
(Continued)

OTHER PUBLICATIONS www.engineeringtoolbox.com/vapor-pressure-d_312.html Vapor Pressure: Saturation pressure—exerted by escaping molecules. Oct. 12, 2007. (Year: 2007).*

(Continued)

*Primary Examiner* — Dah-Wei D. Yuan
*Assistant Examiner* — Kristen A Dagenais-Englehart
(74) *Attorney, Agent, or Firm* — Kagan Binder, PLLC

(57) ABSTRACT

A method of applying a coating to a device which has one or more components housed in a housing. A liquid coating precursor is applied to at least part of the internal surface of the housing and/or at least part of the one or more components within the housing. Low pressure conditions are applied to the closed housing, sufficient to cause the liquid coating precursor to evaporate and initiation of the liquid coating precursor to thereby cause the coating to form on at least some of the internal surfaces of the device.

23 Claims, 2 Drawing Sheets

(51) Int. Cl.
*B05D 3/14* (2006.01)
*B05D 3/04* (2006.01)

(56) References Cited

U.S. PATENT DOCUMENTS

| | | | | |
|---|---|---|---|---|
| 6,764,758 | B1 | 7/2004 | Grunze et al. | |
| RE43,651 | E | 9/2012 | Badyal et al. | |
| 8,852,693 | B2 | 10/2014 | Legein et al. | |
| 2004/0028931 | A1* | 2/2004 | Bletsos | B32B 27/06 428/500 |
| 2004/0046165 | A1 | 3/2004 | Hunze et al. | |
| 2009/0267489 | A1 | 10/2009 | Arita et al. | |
| 2010/0021998 | A1 | 1/2010 | Sanyal et al. | |
| 2010/0189914 | A1 | 7/2010 | Coulson | |
| 2010/0203347 | A1 | 8/2010 | Coulson | |
| 2012/0009231 | A1 | 1/2012 | Herbert et al. | |
| 2012/0051018 | A1 | 3/2012 | Øllgaard | |
| 2012/0171386 | A1 | 7/2012 | Bicker et al. | |
| 2012/0321776 | A1 | 12/2012 | Vetrecin | |
| 2014/0010969 | A1 | 1/2014 | Bicker et al. | |
| 2014/0322525 | A1 | 10/2014 | Legein et al. | |
| 2014/0342103 | A1 | 11/2014 | Petersen et al. | |
| 2015/0291830 | A1 | 10/2015 | Galbreath et al. | |
| 2016/0284518 | A1 | 9/2016 | Legein et al. | |

FOREIGN PATENT DOCUMENTS

| | | | | |
|---|---|---|---|---|
| EP | 2711153 | A1 | 3/2014 | |
| GB | 2434368 | A | 7/2007 | |
| GB | 2493264 | A * | 1/2013 | B05D 1/62 |
| GB | 2493264 | A * | 1/2013 | B05D 1/62 |
| WO | 9858117 | A1 | 12/1998 | |
| WO | 0228548 | A2 | 4/2002 | |
| WO | 2003/063938 | A1 | 8/2003 | |
| WO | 03097245 | A2 | 11/2003 | |
| WO | 03101621 | A2 | 12/2003 | |
| WO | 2004065664 | A2 | 8/2004 | |
| WO | 2005/021833 | A2 | 3/2005 | |
| WO | 2005/089961 | A1 | 9/2005 | |
| WO | 2005089961 | A1 | 9/2005 | |
| WO | 2006129800 | A1 | 12/2006 | |
| WO | 2007/083122 | A1 | 7/2007 | |
| WO | 2007083122 | A1 | 7/2007 | |
| WO | 2009/030435 | A1 | 3/2009 | |
| WO | 2009/046093 | A2 | 4/2009 | |
| WO | 2011/029628 | A1 | 3/2011 | |
| WO | 2012158953 | A2 | 11/2012 | |
| WO | 2013132250 | A1 | 9/2013 | |
| WO | 2014026967 | A2 | 2/2014 | |
| WO | 2014155099 | A1 | 10/2014 | |
| WO | 2016198855 | A1 | 12/2016 | |
| WO | 20160198856 | A1 | 12/2016 | |
| WO | 20160198857 | A1 | 12/2016 | |

OTHER PUBLICATIONS

Search Report under Section 17(5) from UK Patent Application No. GB1403558.8, dated Aug. 13, 2014 (4 pages).
International Search Report and Written Opinion from International Application No. PCT/GB2015/050521, dated Jun. 5, 2015 (16 pages).
Search Report under Section 17(5) from UK Patent Application No. GB1503054.7, dated Nov. 30, 2015 (4 pages).
"Plasma treatment can apply liquid repellency to any material", Technical Textiles International, May 2005 (3 pages).
International Search Report and Written Opinion from International Application No. PCT/GB2016/051686, dated Oct. 6, 2016, (14 pages).
International Search Report and Written Opinion for International Application No. PCT/GB2016/051687, dated Nov. 7, 2016, (9 pages).
International Search Report and Written Opinion for International Application No. PCT/GB2016/051688, dated Nov. 8, 2016, (9 pages).
Bongiovanni et al., "High performance UV-cured coatings for wood protection", Progress in Organic Coatings, 2002, 45, 359-363, (5 pages).

* cited by examiner

COATING

FIELD OF THE INVENTION

This invention relates to a novel method of applying coatings to articles and articles coated by this method. In particular, the invention is directed to applying coatings to the internal surfaces of articles, such as electronic or electrical devices.

BACKGROUND TO THE INVENTION

Electronic and electrical devices are sensitive to contamination by liquids, in particular water, which can cause short circuiting between electronic or electrical components and corrosion on components such as circuit boards, electronic chips etc.

Portable, handheld and wearable devices are particularly at risk to damage from contamination by liquids, due to the high probability of them being exposed to environmental liquids, such as rain or steam from bathrooms. Handheld devices are particularly vulnerable to being accidentally splashed or dropped into liquid. In particular, electronic devices such as mobile phones, tablets, pagers, radios, hearing aids, laptops, notebooks, palmtop computers and personal digital assistants (PDAs) are all particularly at risk of being damaged by contamination with liquids.

In addition to electronic and electrical devices, it is desirable to apply coatings to a range of other products to enhance their performance. For example, the provision of liquid repellent coatings on laboratory equipment (such as pipette tips) has the advantage of minimising retention of reagents and thus increasing accuracy.

The use of plasma deposition techniques is known for the deposition of polymeric coatings onto a range of surfaces. This technique is recognized as being a clean, dry technique that generates little waste compared to conventional wet chemical methods. Using this method, plasmas are generated from organic molecules, which are subjected to an electrical field. When this is done in the presence of a substrate, the radicals of the compound in the plasma polymerize on the substrate. Conventional polymer synthesis will produce structures containing repeat units of the monomer species; whereas a polymer network generated using a plasma can be extremely fragmented, complex and irregular. The properties of the resultant coating can depend upon the nature of the substrate as well as the nature of the monomer used and conditions under which it is deposited.

Conventionally, a substrate to be coated is placed into a plasma chamber and the monomer is introduced into the chamber whilst the plasma is applied, resulting in a polymeric coating being mainly formed on the external surface of the substrate.

WO2005/021833 describes an apparatus for forming a coating via plasma polymerization in which the monomer is held in liquid form, for example in a syringe, and supplied into the plasma chamber via ultrasonic nozzles. Alternatively, the liquid monomer may be vaporized before entering the ultrasonic nozzles.

WO 2007/083122 describes a method of applying a polymer layer to electronic or electrical devices by plasma polymerisation in order to protect them from liquid damage. The polymer layer is applied either to the outer surface of a fully assembled device or an individual component. In both cases, the electronic or electrical device is placed in a plasma chamber along with the material to be deposited in the gaseous state.

Electronic or electrical devices typically comprise electronic and/or electrical components housed within an enclosure. The applicants have discovered that when treating fully assembled electronic or electrical devices by plasma polymerisation using prior art methods, the amount of coating on the internal surfaces of the electronic or electrical device (i.e. the internal surfaces of the enclosure and/or surfaces of the electronic and/or electrical components) is limited due to a lack of diffusion of the monomer into the device.

It is already known to treat the electronic and/or electrical components individually before assembling into the electronic or electrical device but this approach can interfere with the working of the phone due to the coating on the contacts or be unattractive and costly in mass manufacturing Whilst much faster than wet chemistry techniques, prior art techniques of applying coatings by plasma polymerisation are currently too slow for them to be used 'in-line' during the manufacturing process of the electronic or electrical device. These prior art techniques require steps to 'outgas' the items being treated (i.e. drive off absorbed or trapped gases or vapours in the item) before coating, typically by exposing the item to reduced pressure within the chamber; these steps add significant time to the process. For example, a typical process time for treating an assembled mobile phone by prior art methods is 90 minutes per batch, which is too slow for the required takt time of <24 seconds required in the in-line process.

Statements of the Invention

According to a first aspect of the present invention there is provided a method of applying a coating to a device, the device comprising one or more components housed in a housing, the method comprising the steps of:

(i) applying liquid coating precursor to at least part of the internal surface of the housing and/or at least part of the one or more components;

(ii) applying below atmosphere pressure conditions to the closed housing, with the one or more components inside the housing, the pressure conditions being sufficient to cause the liquid coating precursor to evaporate; and (iii) initiation of the liquid coating precursor, to thereby cause the coating to form from the liquid precursor on at least some of the internal surfaces of the device.

The coating may comprise a liquid repellent coating, in particular a water and/or oil repellent coating. As the liquid repellent coating is applied inside the housing of the device, the coating is very effective. Sources of liquids from which the devices are protected include environmental liquids such as water, and in particular rain, sea water, humidity as well as any other oil or liquid, which may be accidentally spilled. In addition, anti-microbial/anti-bacterial properties may also be displayed due to the lack of moisture uptake which will inhibit growth. In addition or alternatively, the coating may have a low dielectric constant.

Activation of the liquid coating precursor may comprise applying an energizing and/or ionization field. The energizing and/or ionization field comprises a plasma, for example the coating may be formed by plasma polymerization. Alternatively the energizing and/or ionization field/precursor activation is selected from penning ionization, laser, atmospheric based plasmas, free radical initiators and light of electromagnetic wavelength including visible and infrared light. Alternatively, activation of the liquid coating precursor may comprise initiated and oxidative chemical vapour deposition.

The coating may comprise a polymer coating. In this case, the precursor may be referred to as a monomer.

This method has the advantage that an outgassing process step for the device (i.e. driving off gases/vapours dissolved or trapped in the device) is not required; this is due to the fact that the precursor is dispensed locally and can cope with high level of moisture inside the housing. As the outgassing step can be dispensed with, the process is much faster than prior art methods, typically under 10 minutes per batch in comparison with 90 mins for prior art techniques. Therefore, the applicants have successfully created a method with a sufficiently short process time and takt time per device to make the coating suitable for applying within an assembly line. Therefore, in one embodiment, the device is not dried or outgassed before application of the liquid coating precursor.

The coating may be applied during the assembly line of the electronic or electrical device, for example at the end of the line. The method of applying the coating is suitable for both batch and continuous processes. This method is particularly suitable for applying during the assembly line of an electronic or electrical device, for example a mobile phone.

The liquid coating precursor may be applied at multiple locations, which may be chosen to optimize the performance of the coating. For example a liquid repellent coating may be applied at locations close to apertures in the housing and/or locations vulnerable to liquid damage (e.g. locations prone to corrosion).

The method of applying the liquid coating precursor in step (i) may comprise spraying or applying the liquid coating precursor as multiple droplets. Alternatively, it may comprise placing a material soaked in liquid coating precursor in the housing. The liquid coating precursor may be applied in the in-line manufacturing process of the electronic or electrical device. The application of the liquid coating precursor in step (i) may be up to 120 minutes and more preferably up to 10 minutes before the application of the ionization field in step (iv). The delay between application of liquid coating precursor and initiation of the liquid coating precursor will depend on the choice of precursor and its rate of evaporation.

The liquid coating precursor may be applied in step (i) directly to the internal surface of the housing and/or at least part of the one or more components within the housing or onto a material attached to said housing and/or one or more component. The material may be absorbent, for example selected from cotton, paper, cellulose, zeolites or other porous material. The method may further comprise the step of applying a removable barrier layer over the dispensed liquid coating precursor and removing the barrier layer prior to closing the housing in step (ii). The removable barrier layer forms a barrier reducing evaporation of the liquid coating precursor, enabling the liquid coating precursor to be applied earlier on in the manufacturing process. This is particular useful if the liquid coating precursor is particular volatile. The removable barrier layer may comprise an adhesive, which allows it to be easily attached and removed, for example a low-tack adhesive. The removable barrier layer may comprise a material selected from polymers or metallic foils.

The method of applying the liquid coating precursor in step (i) is not limited to applying the coating precursor in the liquid state. For example, step (i) may comprise exposing the internal surface of the housing and/or at least part of the one or more components within the housing to a vapour of the coating precursor and subsequently condensing the vapour onto the internal surface of the housing and/or at least part of the one or more components.

The method does not require the housing to be opened for the liquid coating precursor to be applied to the internal surface of the housing and/or at least part of the one or more components within the housing. For example, the liquid coating precursor may be sprayed through apertures in the housing or a vapour of the coating precursor may be introduced through an aperture in the housing, followed by condensation.

The device may comprise an electronic or electrical device. Particular examples of electrical and electronic devices include communications devices such as mobile phones and pagers, radios, and sound and audio systems such as loudspeakers, microphones, ringers or buzzers, hearing aids, personal audio equipment such as personal CD, tape cassette or MP3 players, televisions, DVD players including portable DVD players, video recorders, digi and other set-top boxes such as Sky, computers and related components such as laptop, notebook, tablets or palmtop computers, personal digital assistants (PDAs), keyboards, or instrumentation, games consoles in particular hand-held playstations and the like, or outdoor lighting systems.

In one embodiment the device comprises laboratory equipment. For example, one or more articles of laboratory equipment, such as pipette tips, may be housed in a container. In this case, the container comprises a housing and the one or more articles of laboratory equipment comprise the one or more components.

It is not necessary to expose the external surface of the housing to the liquid coating precursor, except by diffusion from inside the housing; a liquid repellent coating on the internal surfaces will give sufficient protection to the electronic or electrical device without a liquid repellent coating on the external surfaces. However, the external surfaces of the housing may also be coated; In this case the external surface of the housing may be coated simultaneously as the internal surfaces by providing coating precursor in atomized or vaporized form adjacent the external surfaces of the housing as the energizing and/or ionization field is applied, as in prior art techniques.

In one embodiment, the method takes place in a reaction chamber, wherein coating precursor is fed into the reaction chamber so that a polymeric coating is formed on the external surface of the housing. In another embodiment, the method takes place in a reaction chamber, and wherein no coating precursor is fed into the reaction chamber.

The method has the advantage that external discoloration of the housing is less likely to occur. Discoloration can occur when the coating thickness exceeds a certain amount. Higher growth rates under certain conditions such as increased volume of dispensed precursor and/or higher pressures can cause thicker coatings and potential discoloration. By dispensing liquid coating precursor inside the housing, there is no reliance on diffusion of the precursor from outside the housing as in prior art methods. Therefore the volume of precursor used to coat the external surface (if used at all) can be kept low, ensuring a thin coating is produced and thereby avoiding discoloration.

The liquid coating precursor may comprise a single precursor. Alternatively, the liquid coating precursor may comprise two or more different precursors. The two or more different precursors may for example be pre-mixed or they may be applied separately.

The liquid coating precursor may comprise a compound of formula (I)

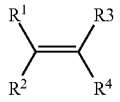

(I)

where $R^1$, $R^2$ and $R^3$ are independently selected from hydrogen, alkyl, haloalkyl or aryl optionally substituted by halo; and $R^4$ is a group X—$R^5$ where $R^5$ is an alkyl or haloalkyl group and X is a bond; a group of formula —C(O)O$(CH_2)_n$Y— where n is an integer of from 1 to 10 and Y is a bond or a sulphonamide group; or a group —$(O)_pR^6(O)_q(CH_2)_t$— where $R^6$ is aryl optionally substituted by halo, p is 0 or 1, q is 0 or 1 and t is 0 or an integer of from 1 to 10, provided that where q is 1, t is other than 0.

The liquid precursor may comprise a compound of formula (II)

$$CH_2{=}CR^7C(O)O(CH_2)_nR^5 \quad (II)$$

where n is an integer from 1 to 10, $R^5$ is an alkyl or haloalkyl group and $R^7$ is hydrogen, $C_{1-10}$alkyl, or $C_{1-10}$haloalkyl.

The liquid precursor may be selected from 1H,1H,2H, 2H-Perfluorooctyl acrylate and 1H, 1H, 2H, 2H-heptadecafluorodecyl acrylate.

The coating may be formed by plasma polymerization. Precise conditions under which the plasma polymerization takes place in an effective manner will vary depending upon factors such as the nature of the monomer, the device etc. and will be determined using routine methods and/or the techniques.

Suitable plasmas for use in the method of the invention include non-equilibrium plasmas such as those generated by radiofrequencies (RF), microwaves or direct current (DC).

They operate at sub-atmospheric pressures as are known in the art. In particular however, they are generated by radiofrequencies (RF).

Various forms of equipment may be used to generate gaseous plasmas. Generally these comprise containers or plasma chambers in which plasmas may be generated. Particular examples of such equipment are described for instance in WO2005/089961 and WO02/28548, the content of which is incorporated herein by reference, but many other conventional plasma generating apparatus are available.

In general, the item to be treated is placed within a plasma chamber with the material to be deposited, a glow discharge is ignited within the chamber and a suitable voltage is applied, which may be either continuous wave or pulsed.

The gas used within the plasma may comprise an inert gas such as helium or argon, a vapour of the precursor compound, or a mixture of the two. Where a vapour of the precursor compound is used, a coating will form on the external surface of the housing in addition to the interior surface.

The amount of liquid coating precursor applied inside the housing will depend to some extent on the nature of the particular monomer being used, the nature of the device being treated, the size of the plasma chamber, the size of the object being processed etc. However, it is preferably in the range of 1nl to 10ml, more preferably 1μl to 200μl, which is particularly suitable for mobile handheld devices.

In all cases, a glow discharge is suitably ignited by applying a high frequency voltage, for example at 13.56MHz. This is suitably applied using electrodes, which may be internal or external to the chamber, but in the case of the larger chambers are internal.

The low pressure conditions range from 0.1mtorr to 1000mtorr, the pressure conditions used depends strongly on the used volume and choice of monomer as well as the substrate temperature.

The applied fields are suitably of power of from 1 to 2000W, suitably at about 100W peak power, the power used being strongly dependent on size of the reaction chamber. If pulsing is used, the pulses are applied in a sequence which yields very low average powers, for example in a sequence in which the ratio of the time on : time off is in the range of from 1:1 to 1:3000. Particular examples of such sequence are sequences where power is on for 20-50μs, for example about 30μs, and off for from 1000μs to 30000μs, in particular about 20000μs. Typical average powers obtained in this way are 0.01W. Good results have been achieved using a continuous wave plasma. On:off ratios of X:1, with X being in the range of between >1 and infinity create fields which effectively act as continuous wave plasma.

The fields are suitably applied from 1 second to 90 minutes, preferably from 0.1 to 60 minutes, depending upon the nature of the compound of formula (I) and the device etc.

Suitably a plasma chamber used is of sufficient volume to accommodate multiple devices, in particular when these are small in size.

A particularly suitable apparatus for producing devices in accordance with the invention is described in WO2005/089961, the content of which is hereby incorporated by reference.

The chamber may be a sealable container, to allow for batch processes, or it may comprise inlets and outlets for electrical or electronic devices, to allow it to be utilised in a continuous process. In particular in the latter case, the pressure conditions necessary for creating a plasma discharge within the chamber are maintained using high volume pumps, as is conventional for example in a device with a "whistling leak".

A second aspect of the present invention provides a device which comprises a coating of a polymer which has been applied by a method according to any one of the preceding claims.

A third aspect of the invention provides an electronic or electrical device which comprises a coating which has been applied by a method according to any one of the preceding claims.

A fourth aspect of the invention provides an item of laboratory equipment which comprises a coating which has been applied by a method according to any one of the preceding claims.

Throughout the description and claims of this specification, the words "comprise" and "contain" and variations of the words, for example "comprising" and "comprises", mean "including but not limited to", and do not exclude other components or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, characteristics, compounds, chemical moieties or groups described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

Where upper and lower limits are quoted for a property, then a range of values defined by a combination of any of the upper limits with any of the lower limits may also be implied.

The present invention will now be further described with reference to the following non-limiting examples and the accompanying illustrative drawings, of which:

EXAMPLE 1

Monomer Deposited Inside Mobile Phone Coating

Droplets of 1H, 1H, 2H, 2H-heptadecafluorodecyl acrylate (Apollo PC04389E, 95%+purity) were deposited onto the inside of mobile phone enclosures before subjected them to the plasma polymerization process. The mobile phone enclosures were made from ABS and had dimensions of 70mm×135mm, with two circular apertures of 5mm diameter. A sheet of cotton poplin of dimensions 60mm×130mm was placed inside each enclosure and droplets of monomer were applied to the cotton poplin using an adjustable micropipette in different volume and distribution patterns. The enclosures were then closed and subjected to the plasma polymerization process.

Figure 1:
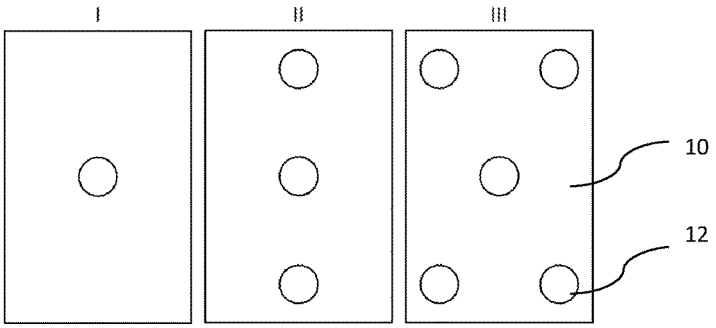
FIG. 1 shows three different distribution patterns of monomer on cotton poplin placed onto the internal surface of an enclosure.

The different distributions of monomer used in following examples are shown in FIG. 1, which shows enclosures 10 and monomer droplets 12; distributions patterns I,II and III have 1,3 and 5 droplets respectfully. In this example, 1 droplet of 15μl (pattern I of FIG. 1) was compared to 3 droplets, each 5μl (pattern II in FIG. 1) in order to determine any difference between application in a single area and multiple areas spread fairly evenly. The same total volume of monomer was used to allow potential differences caused by insufficient monomer to be ruled out.

After the droplets of monomer were applied to the internal surfaces of the enclosures as described above, the enclosures were closed and placed inside a capacitive coupled plasma reactor vessel. The plasma reactor vessel used was rectangular, with a volume of 90l. The plasma reactor vessel had grounded reactors walls and RF powered electrodes made of the same material as the reactor. The enclosures were placed between the electrodes and the walls. The reactor was evacuated using a vacuum pump reaching base pressures lower than 4mTorr with the process pressure being sub-atmospheric. A cold plasma was generated by pulsed and continuous radio frequency of 13.56MHz applied between the electrodes and grounded walls. At the end of the process, the plasma reactor vessel was vented to atmospheric pressure in order to remove the treated materials.

1H, 1H, 2H, 2H-heptadecafluorodecyl acrylate (Apollo PC04389E, 95%+purity)is also placed in a monomer tube connected to the plasma reactor vessel.

The enclosure is then subjected to either process A or process B outlined below. In example 1, process A is used.

Process A:

The processing chamber had a start pressure of 80mT and was then further pumped down for 20 sec to below 30mT at which a 30 sec outgas check was performed (OGR). A continuous plasma (CW) was then applied for 30s at a power of 300W, after 10 sec into the CW a first shot of monomer (128μl) from the monomer tube was introduced into the chamber. Following application of the continuous wave plasma, a pre-shot of monomer (each 128μl) from the monomer tube was applied to the chamber. The pulsed plasma was then ignited, followed by introducing a further shot of monomer (128μl) from the monomer tube into the chamber under pulsed conditions (pressure=30mT, time=20s, power=400W and a pulse regime of 37μs on and 10ms off). After the plasma treatment has finished, the chamber was cleared for 180 sec.

Process B:

The processing chamber had a start pressure of 80mT at which a continuous plasma (CW) was applied for 30s at a power of 300W whilst further pumping the chamber to 30mT. After 10 sec into the CW a first shot of monomer (12μl) from the monomer tube was introduced into the chamber. Following application of the continuous wave plasma, a pre-shot of monomer (each 128μl) from the monomer tube was applied to the chamber. The pulsed plasma was then ignited, followed by introducing a further shot of monomer (128μl) from the monomer tube into the chamber under pulsed conditions (pressure=30mT, time=20s, power=400W and a pulse regime of 37us on and 10ms off). After the plasma treatment has finished, the chamber was cleared for 180 sec.

Measurements

The cotton in the ABS enclosures coated as described above were tested using a water repellency scale similar to the AATCC193-2003 method ("Water/Alcohol Solution Resistance Test"). The ratings used are reproduced in table 1.

TABLE 1

| Rating | % Deionised Water (by volume) | % Isopropanol (by volume) | Surface Tension at 22° C. with 3SD tolerances (mN/m) |
|---|---|---|---|
| W0 | 100 | 0 | 72.8 ± 2.0 |
| W1 | 90 | 10 | 42.1 ± 2.3 |
| W2 | 80 | 20 | 33.7 ± 2.0 |
| W3 | 70 | 30 | 28.4 ± 1.4 |
| W4 | 60 | 40 | 26.4 ± 0.8 |
| W5 | 50 | 50 | 25.0 ± 0.5 |
| W6 | 40 | 60 | 24.3 ± 0.2 |
| W7 | 30 | 70 | 23.8 ± 0.3 |
| W8 | 20 | 80 | 23.0 ± 0.2 |
| W9 | 10 | 90 | 22.4 ± 0.3 |
| W10 | 0 | 100 | 21.2 ± 0.2 |

An approximately 30μl drop of deionized water/isopropanol (mixed according to table 1) is gently placed onto the cotton surface to be investigated. After 10 sec the drop is removed and the cotton observed for wetting. If wetting occurred then this counts as a fail. If there is no wetting, it is a pass and the procedure is repeated using the percentage mix in the next line of table 1 until the coating fails. The coating is given the highest rating it passes.

Figure 2:
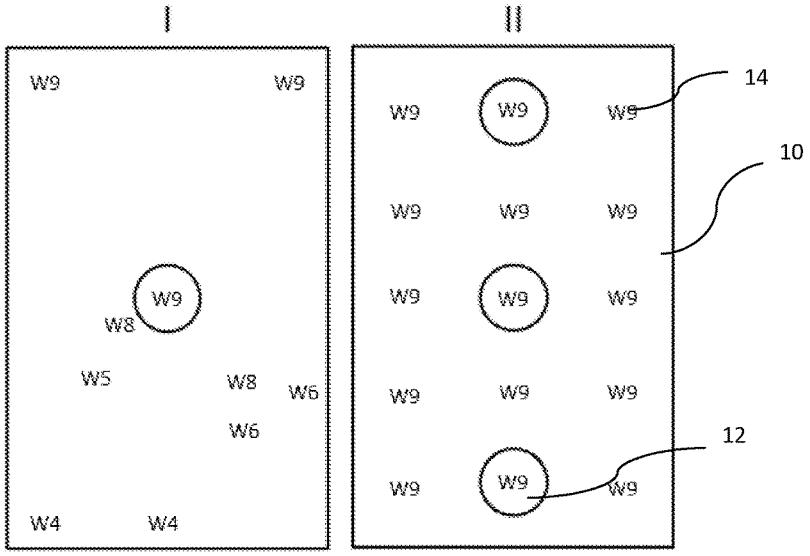
FIG. 2 shows the values of the water repellency results on various locations of enclosures treated with monomer; 1 droplet of 15μl (pattern I) and 3 droplets of 5μl each (pattern II)

This test method was applied to evaluate the cotton pieces treated inside the enclosures. The 1 droplet of 15μl (pattern I in FIG. 1) was then compared to 3 droplets, each 5μl, (pattern II in FIG. 1). The results of the water repellency test are shown in FIG. 2, which shows values 14 at different positions tested on the enclosure 10. It was found that a single droplet in the centre of the cotton led to a non-uniform coating with some areas performing worse than others, whilst the smaller droplets spread farther apart produced a uniformly well-performing coating.

EXAMPLE 2

Control Enclosures

A control enclosure which contained no monomer internally was treated under the same conditions as Example 1 (using process A). In this case, any coating being produced was entirely from the monomer introduced into the chamber during the CW and PW stages of the process.

The results of the water repellency test show that the control enclosure had practically no coating internally with the exception of the two spots where there are holes in the ABS.

EXAMPLE 3

Time Study—Dispensing Monomer On Cotton

A 3μl drop of monomer was placed on the cotton and observed over 16 minutes. The drop was visually inspected and none observed to evaporate after this time had lapsed. Subsequent plasma treatment using process A of example 1 showed water repellency numbers of 9.

Due to the high boiling point of ~250° C., the monomer soaks into the cotton without losing too much to evaporation. This indicates that it is possible to dispense the monomer a reasonable time before exposure to the plasma, making it suitable for application in production.

This example shows that a suitable soaking material allows the monomer to evaporate sufficiently after a defined period of soaking time.

EXAMPLE 4

Depositing Monomer on ABS

Figure 3:
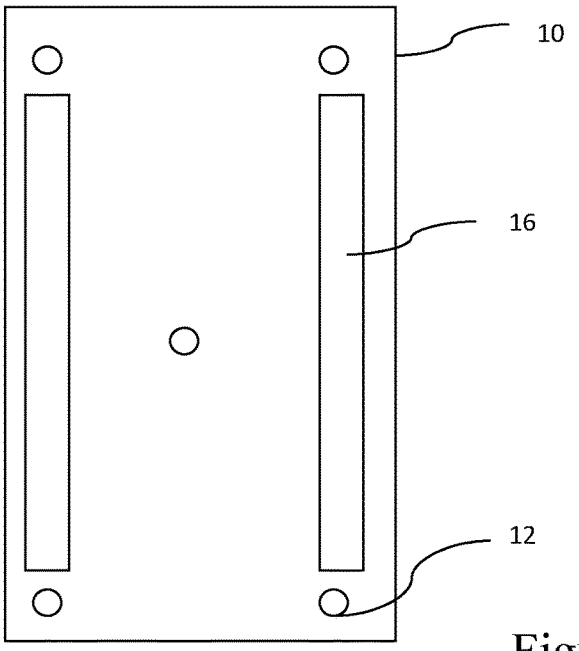
FIG. 3 shows an enclosure with monomer droplets directly on the ABS surface in pattern III.

Monomer was dispensed directly on the ABS enclosure in distribution pattern III, as illustrated in FIG. 3. Cotton strips 16 were also placed in the enclosure as witness pieces. In a first experiment, the volume of each droplet was 1μl whilst in a second experiment the volume of each droplet was 3μl. The enclosures were left open for 23 minutes, after which the droplets were inspected.

After a period of 23mins, there was no visible loss of monomer through evaporation. Subsequent plasma treatment using process A of example 1showed water repellency numbers of 9 for 3μl and 4 for 1μl showing a clear difference in evaporation rates during vacuuming to cotton doped enclosures. This shows that monomer can be applied to an ABS enclosure in production, with a time delay prior to plasma treatment, without significant loss of monomer.

EXAMPLE 5

Treating Metal

Figure 4:
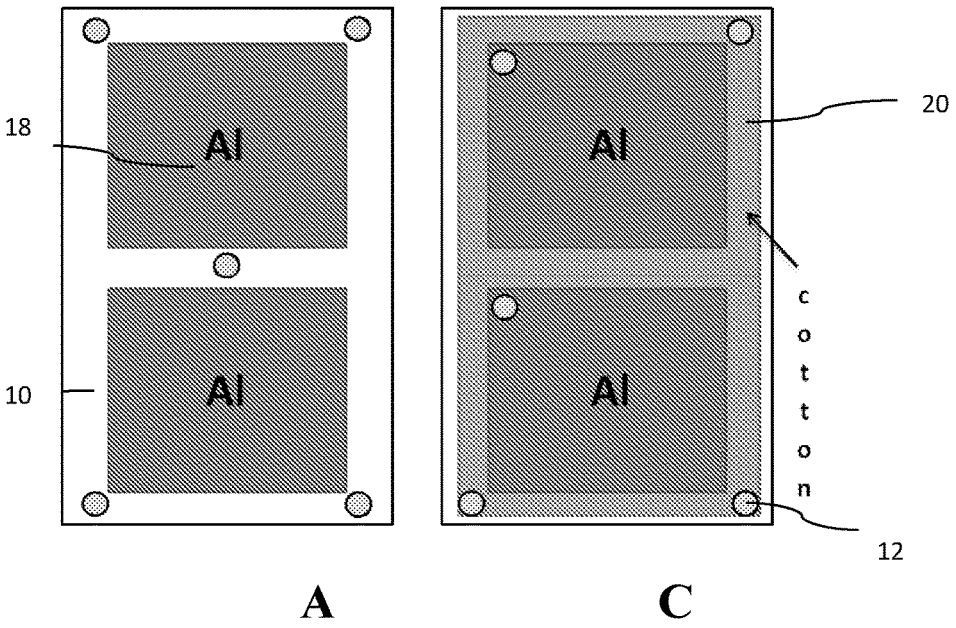
FIG. 4 shows two enclosures with aluminium samples inside and monomer droplets in pattern III.

Aluminium samples 18 were placed in the enclosures 10, one with cotton 20 and one without cotton, as illustrated in FIG. 4. The 5×3μl monomer drops 12 were placed as shown in the distribution pattern III and treated using the process of Example 1.

After treatment with process A, no monomer was left behind. Contact angles of the treated enclosure were measured using the VCA Optima (by ACT Products Inc.). The contact angle measurements showed good results averaging 118° on the aluminium and 115° on the outside of the ABS.

EXAMPLE 6

External Coating

The external coating was characterized using colour-change measurements (ΔE94, equipment: x-rite) and contact angle measurements for runs using Process A (described in Example 1). In total 3 runs were analysed and showed an average ΔE94 of 0.23, (pass=<1) and an average contact angle of 117.0° (CV 1.3%) for the outside surface of the ABS enclosures. This demonstrates that an external coating is indeed being produced, and that the monomer that is introduced during the process is sufficient to pass both the discolouration and CAM tests.

EXAMPLE 7

30×1μl droplets of 1H,1H,2H,2H-Perfluorooctyl acrylate were evenly placed into an ABS enclosure. The ABS enclosure contained a cotton poplin sheet for evaluation reasons. After dispensing the monomer, the ABS enclosure was closed and placed inside a 20 liter vacuum chamber, similar to the 9 l chamber used in examples 1-7. The pressure was reduced to 250mT, at which the plasma was struck using a 100W continuous wave radio frequency (13.56MHz). The pressure was then further lowered to 100mT and then quickly raised to 200mT process pressure. After 65 sec have passed the RF was switched off and the chamber evacuated for 30 sec, followed by venting. The total process time was 140 sec. This process resulted in water repellency values of up to W9 whilst no noticeable change to the visual appearance of the enclosure outside was observed.

EXAMPLE 8

Mobile Phone Treatment

The process of coating the internal surface of a mobile phone case was compared with a coating applied by conventional methods and with an untreated phone. In the conventional method, any coating of internal surfaces is via diffusion of the precursor from outside the housing.

Processes:

Internal Treatment of Phone:

A mobile phone was treated using the below stated parameters for a modified version of the monomer dispensing method of process B in Example 1, conducted in a 90 liter machine.

17×1μl droplets of 1H,1H,2H,2H-Perfluorooctyl acrylate were distributed around the phone surface inside the mobile phone housing prior to plasma treatment. During the plasma treatment an additional small quantity of monomer was delivered externally to achieve a technical effect on the phone outside. The following process parameters were used:

- Pressure: Start pressure 80mT (reached after 67 sec), process pressure 30mT,
- CW: 300W, 30 sec CW, 10 sec delay+1 shot (shot size=16μl)
- PW: 1PW pre-shots, 400W; 35us on/10ms off, ~19 sec PW, 1 shot Clearing: 300 sec Monomer: Total quantity used internal=17μl and external=384μl.

Total process time: 7 min

Conventional Phone Treatment:

A mobile phone was treated using P2i Ltd's 4001standard process, with monomer applied into the reactor in its vaporized state. Activation of the monomer is achieved by plasma ionization using a 13.56MHz radio frequency generator. The polymerization process allows deep penetration of the coating into the enclosure, but takes about 90min Cotton Enclosures in Both Processes:

ABS enclosures, including cotton sheets inside them (with monomer dispensed in the same volume and distribution pattern as the mobile phones), were placed next to the mobile phones inside the processing chamber.

Evaluation Method Description:

Shower Test

The treated mobile phone was exposed to a shower test, described in more detail below.

This test is similar to the IP-X1 test as stated in the Ingress Protection (IP) Rating: IEC60529: 2001 (Degrees of Protection Provided by Enclosures (IP code), 2001). The IP rating describes the level of protection a device has against solid and liquid objects. The IP rating is stated as IP-X1; the first digit after the dash stands for protection against solid objects and the second digit for protection against liquid objects. As the investigation was limited to protection against liquid objects, the first digit is replaced with an X.

The phone is exposed to a drip box for a total of 30 min with a flow rate of 9±1.0mm/min IP-X1 specifies 10min and a flow of 1.0±0.5mm/min with the device checked for functionality after 10 minutes. In addition to the IP-X1, device checks similar to IP-X2 were performed. For the in-house shower test, general device functionality was checked (power button, volume button, speaker, screen functionalities (touch and display), front and back cameras) every 2 min until 10 min were reached. From this point onwards functionality was checked every 4 min until 30 minutes have passed. The phone's weight was taken before and after the shower test. The device functionality was also checked 24 hours after the test followed by investigation of corrosion on the internal components.

CAM

After shower test evaluation the phones were dismantled and contact angles measured on the internal surfaces using the same method as described in Example 5.

Shower Test Results

Untreated Phone:

The untreated phone failed to pass the shower test with the phone not functioning after 4 minutes exposure. Water was allowed to penetrate into the phone causing short circuits stopping it from operating.

Internal Treatment of Phone:

Treating the phone with this method resulted in a good shower test performance. The test was stopped after 30 minutes as the phone survived the whole time with only minor issues to be reported from minute 22 onwards. These were power and volume button response issues. The button initially needed to be pressed twice for response, working as normal afterwards. The phone was fully functioning when inspected for corrosion the day after the shower test.

Conventional Phone Treatment: The phone treated with standard process passed the shower test, but had some display problems due to electric shorts of components related to the touch screen. It was observed that after removing the phone from the shower tester and held horizontally the display showed menus being opened and closed making it impossible to operate the phone at all. The phone always returned to normal operation once held in a vertical orientation to allow water to drain out. After the shower test the phone was left to dry, a final check the following day indicated that all functions were still intact.

CAM Results

Water contact angle measurements after the shower test are shown in table 2.

TABLE 2

Water contact angle measurements

| Phone | Water contact angles |
|---|---|
| Untreated | 80°-100° |
| Internal treatment of phone | 90°-120° |
| Conventional phone treatment | 90°-120° |

Measured internal water contact angles show that both treated phone average 109° ranging from 90° to 120°. The untreated mobile phone has average contact angles of 85°. This shows that both processes deliver sufficient internal coating thickness. The contact angle positions show that polymerization of the monomer vapour is best closest to possible entry points of the phone. This is thought to be caused by active species created by the plasma ionization (such as nitrogen, oxygen, water and monomer related species) initiating polymerisation inside the mobile phone housing.

Cotton Enclosures

Table 3 lists water repellency results for the cotton enclosures for the 901 dispense study and P2i's 4001 conventional process. The enclosure treated with the dispensed monomer in the 901 chamber achieved W10 all across the cotton produced in a 7 min process as described here in Example 8. All measured enclosures of the 4001standard process achieved W9 across the cotton as the vacuum stage is long enough (20 min) to remove moisture allowing optimum coating penetration.

TABLE 3

Enclosure results conventional (400l) vs. dispensed monomer (90l) method

| Enclosure | Top | ⅓ | ½ | ⅔ | Bottom | Hole | μl/enc |
|---|---|---|---|---|---|---|---|
| 90l-Dispensed | 10 | 10 | 10 | 10 | 10 | 10 | 22 |
| 400l-Conventional | 9 | 9 | 9 | 9 | 9 | 9 | 10 |

Conclusion

This new method of treating electronic and electrical devices allows coating inside the device much faster than with conventional processes whilst giving good protection against liquids. The examples show that the method produces high internal contact angles, low discoloration and good shower test performance.

By dispensing monomer locally inside the housing, a coating can be deposited despite high level of moisture inside the device, thus making a drying or degassing step unnecessary. For this reason, the method is significantly faster than prior art methods in which the monomer is introduced into the plasma chamber, externally to the device.

The internal dispensing of monomer also reduced the risk of discoloration of the external surface because as monomer is being applied locally inside the device, low volumes can be used to treat the external surface.

This new method of treating devices has produced a highly effective liquid repellent coating in a much faster time than prior art methods, which makes the process suitable for using in an in-line manufacturing process.

The method of application allows for the precursor to be applied at critical locations, further improving the repellency in those areas. Small and multiple dispense volumes in a tightly packed enclosure, such as a phone, are beneficial for coating distribution.

The invention claimed is:

1. A method of applying a coating to an electronic or electrical device, the method comprising the steps of:

(i) providing an electronic or electrical device comprising one or more components housed in a housing of the electronic or electrical device;

(ii) applying liquid coating precursor to at least part of the internal surface of the housing and/or at least part of the one or more components while the housing is open or closed;

(iii) closing the housing if the liquid coating precursor is applied while the housing is open in step (ii);

(iv) evaporating the liquid coating precursor applied in step (ii) by applying below atmosphere pressure conditions to the closed housing, with the one or more components inside the closed housing of the electronic or electrical device in a processing chamber; and (v) initiation of the evaporated coating precursor, to thereby cause the coating to form from the coating precursor on at least some of the internal surfaces of the electronic or electrical device.

2. A method according to claim 1, wherein the initiation of the liquid coating precursor comprises an energizing and/or ionization field.

3. A method according to claim 1, wherein the initiation of the liquid coating precursor is selected from plasmas; penning ionization; laser; initiated and oxidative chemical vapour deposition; free radical initiators; and electromagnetic radiation including visible and infra-red light.

4. A method according to claim 1, wherein the coating is formed by plasma polymerization.

5. A method according to claim 4, wherein the coating is formed using a plasma chosen from a pulsed plasma, a continuous wave plasma, and combinations thereof.

6. A method according to claim 1, wherein the liquid coating precursor is applied in droplets at multiple locations.

7. A method according to claim 1, wherein the liquid coating precursor is applied at locations close to apertures in the housing.

8. A method according to claim 1, wherein the liquid coating precursor is applied at locations vulnerable to liquid damage.

9. A method according to claim 1, wherein the liquid coating precursor is applied at locations prone to corrosion.

10. A method according to claim 1, wherein the electronic or electrical device is selected from communication devices, sound and audio systems, computers or outdoor lighting systems.

11. A method according to claim 1, wherein the device comprises laboratory equipment.

12. A method according to claim 11, wherein the device comprises one or more articles of laboratory equipment, such as pipette tips, housed in a container.

13. A method according to claim 1 wherein step (ii) is chosen from applying the liquid coating precursor by spraying; applying the liquid coating precursor as multiple droplets; placing a material soaked in liquid coating precursor in the housing; and condensing the liquid coating precursor from the gas phase.

14. A method according to claim 1, wherein step (ii) comprises condensing the liquid coating precursor from the gas phase, and the gas phase of the liquid coating precursor is formed by evaporating it at below atmosphere pressure conditions.

15. A method according to claim 1, wherein step (ii) comprises condensing the liquid coating precursor from the gas phase, and the vapour of the liquid coating precursor is introduced through an aperture in the housing.

16. A method according to claim 1, wherein step (ii) is chosen from (a) applying the liquid coating precursor by spraying and (b) introducing the vapour of the liquid coating through an aperture in the housing and condensing the liquid coating precursor from the gas phase; wherein the liquid coating precursor is applied in step (ii) whilst the housing is closed.

17. A method according to claim 1, wherein the external surface of the housing is not exposed to the liquid coating precursor, except by diffusion from inside the housing.

18. A method according to claim 1, wherein liquid precursor is chosen from a compound of formula (I)

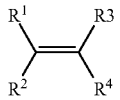

(I)

where $R^1$, $R^2$ and $R^3$ are independently selected from hydrogen, alkyl, haloalkyl or aryl optionally substituted by halo; and $R^4$ is a group X—$R^5$ where $R^5$ is an alkyl or haloalkyl group and X is a bond; a group of formula —C(O)O$(CH_2)_n$Y— where n is an integer of from 1 to 10 and Y is a bond or a sulphonamide group; or a group —$(O)_pR^6(O)_q(CH_2)_t$— where $R^6$ is aryl optionally substituted by halo, p is 0 or 1, q is 0 or 1 and t is 0 or an integer of from 1 to 10, provided that where q is 1, t is other than 0;

a compound of formula (II)

$$CH_2{=}CR^7C(O)O(CH_2)_nR^5 \quad (II)$$

where n is an integer from 1 to 10, $R^5$ is an alkyl or haloalkyl group and $R^7$ is hydrogen, $C_{1-10}$alkyl, or $C_{1-10}$haloalkyl;

1H, 1H,2H,2H-Perfluorooctyl acrylate;

1H, 1H, 2H, 2H-heptadecafluorodecyl acrylate; and combinations thereof.

19. A method according to claim 1, wherein the coating is a liquid repellent coating.

20. A method according to claim 1, wherein the coating is a water and/or oil repellent coating.

21. A device which comprises a coating of a polymer which has been applied by a method according to claim 1.

22. An electronic or electrical device which comprises a coating which has been applied by a method according to claim 1.

23. A method according claim 3, wherein the plasmas comprise atmospheric based plasmas.

* * * * *